US009366437B2

(12) United States Patent
Melton et al.

(10) Patent No.: US 9,366,437 B2
(45) Date of Patent: Jun. 14, 2016

(54) SYSTEM FOR REDUCING FLAME HOLDING WITHIN A COMBUSTOR

(71) Applicant: General Electric Company, Schenectady, NY (US)

(72) Inventors: Patrick Benedict Melton, Horse Shoe, NC (US); James Harold Westmoreland, III, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 640 days.

(21) Appl. No.: 13/721,580

(22) Filed: Dec. 20, 2012

(65) Prior Publication Data

US 2014/0174089 A1 Jun. 26, 2014

(51) Int. Cl.

| | |
|---|---|
| ***F23R 3/28*** | (2006.01) |
| ***F23R 3/02*** | (2006.01) |
| ***F23R 3/00*** | (2006.01) |

(52) U.S. Cl.

CPC ..... *F23R 3/005* (2013.01); *F23R 3/286* (2013.01)

(58) Field of Classification Search

CPC ..... F23R 3/28; F23R 3/286; F23R 3/02; F23R 3/002; F23R 3/05; F02C 7/22

See application file for complete search history.

(56) References Cited

U.S. PATENT DOCUMENTS

| | | | | |
|---|---|---|---|---|
| 6,920,758 | B2 * | 7/2005 | Matsuyama et al. | 60/725 |
| 8,079,218 | B2 | 12/2011 | Widener | |
| 2010/0192579 | A1 * | 8/2010 | Boardman et al. | 60/737 |
| 2010/0255435 | A1 * | 10/2010 | Singh et al. | 431/328 |
| 2011/0113783 | A1 * | 5/2011 | Boardman et al. | 60/723 |
| 2011/0197586 | A1 * | 8/2011 | Berry et al. | 60/722 |
| 2012/0073302 | A1 * | 3/2012 | Myers et al. | 60/748 |
| 2013/0036743 | A1 * | 2/2013 | Khan et al. | 60/772 |
| 2014/0116060 | A1 * | 5/2014 | Melton et al. | 60/755 |

* cited by examiner

*Primary Examiner* — Carlos A Rivera
(74) *Attorney, Agent, or Firm* — Dority & Manning, PA

(57) ABSTRACT

A system for reducing flame holding within a combustor includes a high pressure plenum and a head end plenum defined within the combustor. A cap assembly defines an inner plenum within the combustor and a fuel nozzle passage that extends through the cap assembly. A primary fuel nozzle has an annular burner tube that at least partially defines a premix flow passage through the cap assembly. The primary fuel nozzle and the burner tube at least partially define an inlet to the premix flow passage. A high pressure flow passage and a cooling flow passage are defined within the combustor. The high pressure flow passage defines a flow path between the high pressure plenum and the inner plenum, and the cooling flow passage defines a flow path between the high pressure plenum and the head end plenum.

16 Claims, 6 Drawing Sheets

SYSTEM FOR REDUCING FLAME HOLDING WITHIN A COMBUSTOR

FIELD OF THE INVENTION

The present invention generally relates to a combustor of a gas turbine. More particularly, this invention includes a system for reducing flame holding within the combustor.

BACKGROUND OF THE INVENTION

Gas turbines typically include a compressor, a combustion section downstream from the compressor and a turbine downstream from the combustion section. The combustion section includes at least one combustor that is at least partially enclosed by an end cover that is coupled to an outer casing. The outer casing at least partially defines a plenum around the combustor. At least one fuel nozzle extends downstream from the end cover and at least partially through a cap assembly that extends radially within the casing. An annular liner such as a combustion liner, a transition duct or a transition nozzle extends downstream from the cap assembly. The liner generally includes a plurality of heat transfer features such bumps, ridges, ribs or grooves that extend along an outer surface of the liner. The liner at least partially defines a combustion chamber within the combustor. The liner may also at least partially define a hot gas path that extends between the combustion chamber and an inlet of the turbine.

An annular flow sleeve such as a combustion liner flow sleeve and/or an impingement sleeve surrounds the liner. An annular flow passage is at least partially defined between the outer surface of the liner and an inner surface of the flow sleeve. The annular flow passage at least partially defines a flow path between the plenum and a head end of the combustor which is upstream from the cap assembly. The flow sleeve generally includes a plurality of cooling holes which provide for fluid communication between the plenum and the annular flow passage.

In operation, air enters the compressor through an inlet and is progressively compressed as it flows through the compressor towards the combustion section. The compressed air flows from the compressor into the plenum at a first pressure which is commonly referred to as the compressor discharge pressure. A portion of the compressed air flows through the cooling holes of the flow sleeve and into the annular flow passage. The compressed air is routed through the annular flow passage towards the end cover or head end of the combustor. The compressed air reverses direction at the head end and is routed through or across each fuel nozzle. Fuel from each or some of the fuel nozzles is mixed with the compressed air to form a combustible mixture. The combustible mixture is routed into the combustion chamber where it is burned to produce a hot gas at a highly energized state. The hot gas flows through the hot gas path to the turbine.

The compressed air that is routed through the annular flow passage provides convective and/or conductive cooling to the outer surface of the liner. However, due to friction with the outer surface of the liner and/or an inner surface of the flow sleeve, a significant pressure drop is realized at the head end of the combustor with respect to the compressor discharge pressure. As a result, the pressure of the compressed air that flows through a premix flow passage defined within a burner tube that surrounds a portion of each fuel nozzle may not be sufficient to prevent flame holding at or near a tip portion of the fuel nozzles and/or within the burner tube, thereby increasing thermal stresses at the tip portion and/or limiting the mechanical life of the burner tubes and/or the fuel nozzles and potentially causing damage to surrounding combustor parts and/or to the hot gas path.

In particular combustor designs having a center fuel nozzle surrounded by one or more secondary fuel nozzles comprising one or more tube bundles, also known as a micro mixer system, the center fuel nozzle limits the flame holding capability of the micro mixer system. This is at least partially due to a significant pressure drop of the compressed air at the head end of the combustor with respect to the compressor discharge pressure. This pressure drop is generally caused by friction loses through the annular flow passage, friction losses due the plurality of tubes of the tube bundles and/or additional losses due to a large portion of the compressed air being directed through each of the plurality of tubes. Accordingly, an improved system for providing compressed air to a fuel nozzle, particularly a center fuel nozzle of a combustor would be useful in the art.

BRIEF DESCRIPTION OF THE INVENTION

Aspects and advantages of the invention are set forth below in the following description, or may be obvious from the description, or may be learned through practice of the invention.

One embodiment of the present invention is a system for reducing flame holding within a combustor of a gas turbine. The system includes a high pressure plenum and a head end plenum at least partially defined between a casing and an end cover of the combustor. A cap assembly extends radially within the combustor. The cap assembly includes a base plate positioned downstream from the end cover, a cap plate positioned downstream from the base plate and an annular shroud that extends at least partially therebetween. The base plate and the shroud at least partially define an inner plenum within the cap assembly and the base plate at least partially defines a fuel nozzle passage. A primary fuel nozzle extends from the end cover through the fuel nozzle passage and through the inner plenum. The primary fuel nozzle has an annular burner tube that at least partially defines a premix flow passage through the cap assembly. The burner tube at least partially defines an inlet to the premix flow passage. A high pressure flow passage and a cooling flow passage are defined within the combustor. The high pressure flow passage defines a flow path between the high pressure plenum and the inner plenum, and the cooling flow passage defines a flow path between the high pressure plenum and the head end plenum.

Another embodiment of the present invention is a combustor that includes an end cover coupled to an outer casing. The end cover and the casing at least partially define a head end plenum and a high pressure plenum within the combustor. An annular cap assembly extends radially within the combustor. The cap assembly comprises a radially extending base plate axially separated from a radially extending cap plate and a shroud that extends therebetween. The cap assembly includes an inlet port that extends through the shroud. A fuel nozzle passage is at least partially defined by the base plate. A primary fuel nozzle extends downstream from the end cover and at least partially through the fuel nozzle passage. The primary fuel nozzle includes an annular burner tube that defines a premix flow passage through the primary fuel nozzle. The burner tube at least partially defines an inlet to the premix flow passage. An inner plenum is at least partially defined by the base plate, the cap plate, the shroud and the burner tube. The inlet port defines a flow path into the inner plenum. The inlet of the burner tube defines a flow path between the inner plenum and the premix flow passage. A high pressure flow passage and a cooling flow passage are at least partially defined within the combustor. The high pressure flow passage being in fluid communication with the inlet port of the cap assembly. The high pressure flow passage defines a flow path between the high pressure plenum and the inner plenum. The cooling flow passage defines a flow path between the high pressure plenum and the head end plenum.

Another embodiment of the present invention includes a gas turbine. The gas turbine includes a compressor at an upstream end of the gas turbine, a turbine at downstream end of the gas turbine and a combustor disposed between the compressor and the turbine. The combustor includes an end cover coupled to a casing. The casing is in fluid communication with the compressor. The casing at least partially defines a high pressure plenum that surrounds the combustor. The end cover at least partially defines a head end plenum within the combustor. The combustor further includes a system for reducing flame holding within the combustor. The system comprises a cap assembly that extends radially within the combustor. The cap assembly has a base plate positioned downstream from the end cover, a cap plate positioned downstream from the base plate and an annular shroud that extends at least partially therebetween. The base plate and the shroud at least partially define an inner plenum within the cap assembly. The base plate at least partially defines a fuel nozzle passage. A primary fuel nozzle extends from the end cover through the fuel nozzle passage and through the inner plenum. The primary fuel nozzle includes an annular burner tube that at least partially defines a premix flow passage through the cap assembly. The burner tube at least partially defines an inlet to the premix flow passage. A high pressure flow passage and a cooling flow passage are at least partially defined within the combustor. The high pressure flow passage defines a flow path between the high pressure plenum and the inner plenum, and the cooling flow passage defines a flow path between the high pressure plenum and the head end plenum.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
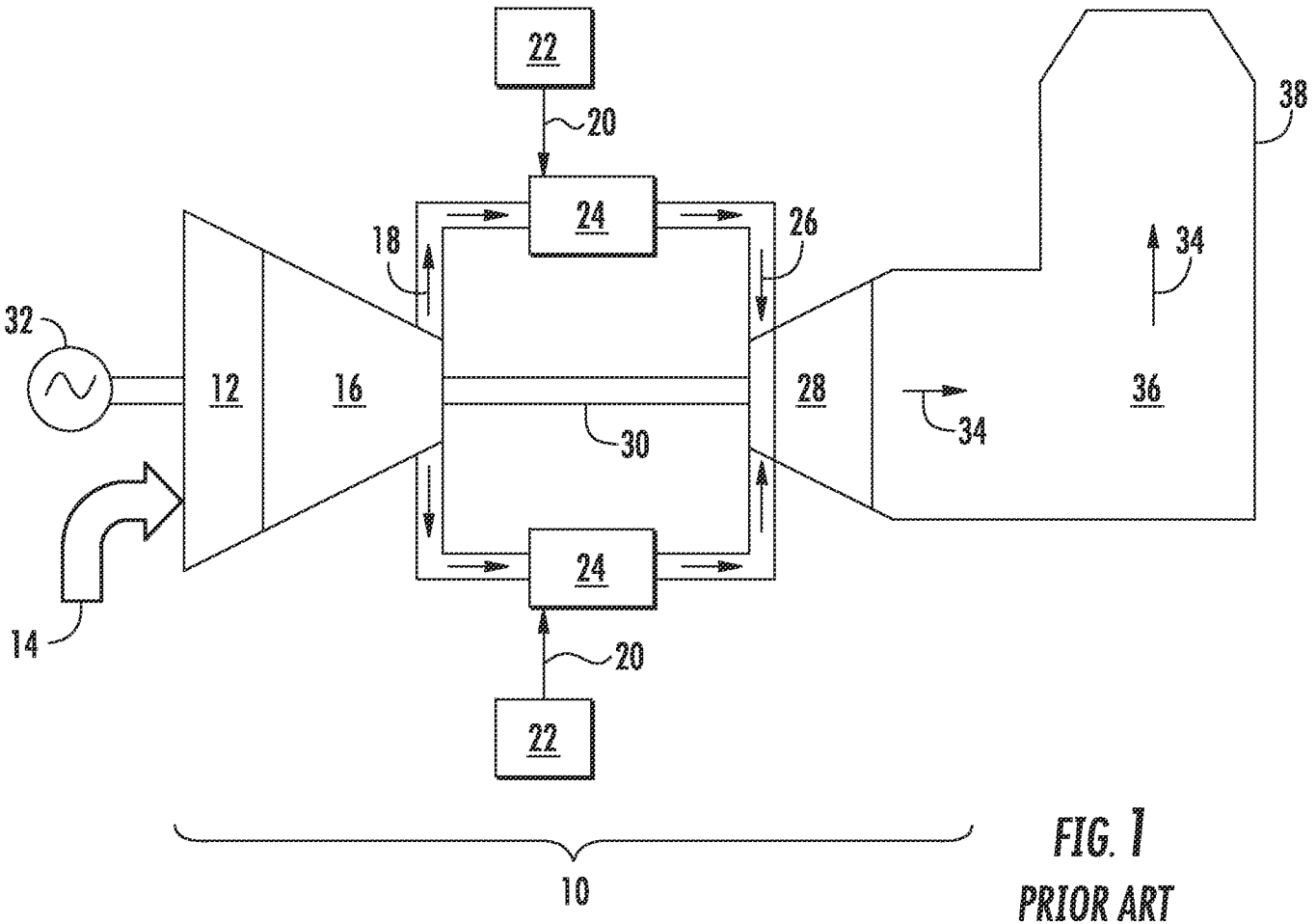
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply system 22 to form a combustible mixture within one or more combustors 24 that are disposed downstream from the compressor 16. The combustible mixture is burned to produce combustion gases 26 having a high temperature and pressure. The combustion gases 26 flow through a turbine 28 of a turbine section. The turbine section may include one or more stages of turbine blades (not shown) that are coupled to a shaft 30. As the combustion gases flow through the turbine 28, thermal and kinetic energy is transferred to the rotor blades thereby causing the shaft 30 to rotate. The shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 26. The exhaust section 36 may include, for example, a heat recovery steam generator (not shown) for cleaning and extracting additional heat from the exhaust gases 34 prior to release to the environment.

Figure 2:
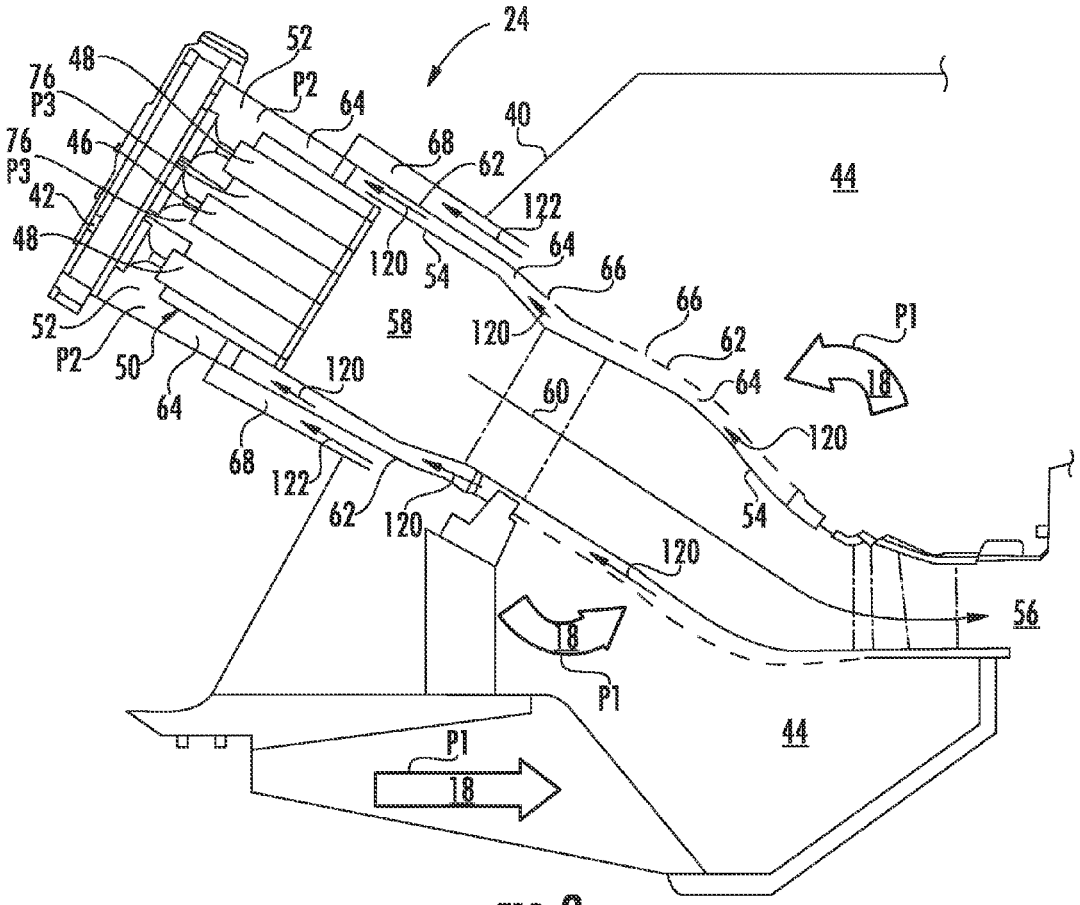
FIG. 2 is a simplified cross-section side view of an exemplary combustor according to various embodiments of the present invention.

The combustors 24 may be any type of combustor known in the art, and the present invention is not limited to any particular combustor design unless specifically recited in the claims. FIG. 2 provides a simplified cross-section side view of an exemplary combustor 24 that incorporates various embodiments of the present invention. As shown in FIG. 2, a casing 40 and an end cover 42 combine to form a high pressure plenum 44 within the combustor 24. The high pressure plenum 44 is in fluid communication with the compressor 16 (FIG. 1). The high pressure plenum 44 receives the compressed working fluid 18 from the compressor at a first pressure P1 which is commonly referred to as compressor discharge pressure.

As shown in FIG. 2, the combustor 24 includes a primary or center fuel nozzle 46 that extends downstream from the end cover 42. In particular embodiments, the combustor 24 includes at least one secondary or outer fuel nozzle 48. The at least one secondary fuel nozzle 48 is disposed radially outward from the primary fuel nozzle 46 and extends downstream from the end cover 42 generally parallel to the primary fuel nozzle 46. In particular embodiments, the combustor 24 may include a plurality of the secondary fuel nozzle 48 that at least partially circumferentially surrounds the primary fuel nozzle 46. A cap assembly 50 extends radially and axially within the combustor 24 downstream from the end cover 42. The cap assembly 50 at least partially surrounds at least a portion of the primary fuel nozzle 46. In addition, the cap assembly 50 may surround at least a portion of the secondary fuel nozzle(s) 48. The end cover 42 and the cap assembly 50 at least partially define a head end plenum 52 within the combustor 24. An annular liner 54 such as a combustion liner, a transition duct and/or a transition nozzle extends downstream from the cap assembly 50 towards an inlet 56 of the turbine 28 (FIG. 1). The liner 54 may be a singular component or may comprise multiple liners coupled together. The liner 54 generally includes various heat transfer features (not shown) such as raised ribs on an outer surface of the liner 54. The liner 54 at least partially defines a combustion chamber 58 that is downstream from the cap assembly 50. The liner 54 may further define at least a portion of a hot gas path 60 that extends from the combustion chamber 58 and at least partially through the high pressure plenum 44 towards the inlet 56 of the turbine 28 (FIG. 1).

As shown in FIG. 2, an annular flow sleeve 62 such as an impingement sleeve or a combustion liner flow sleeve circumferentially surrounds at least a portion of the liner 54. The flow sleeve 62 may be a singular component or may comprise multiple flow sleeves coupled together. The flow sleeve 62 is radially separated from the liner 54 to at least partially define a cooling flow passage 64 therebetween. A plurality of holes 66 extend through the flow sleeve 62 to provide for fluid communication between the high pressure plenum 44 and the cooling flow passage 64. In particular embodiments, a high pressure flow passage or bypass flow passage 68 is at least partially defined within the high pressure plenum 44. For example, the high pressure flow passage 68 may be at least partially defined between the flow sleeve 62 and the casing 40. The high pressure flow passage 68 is radially or otherwise separated from the cooling flow passage 64. The high pressure flow passage 68 is in fluid communication with the high pressure plenum 44.

Figure 3:
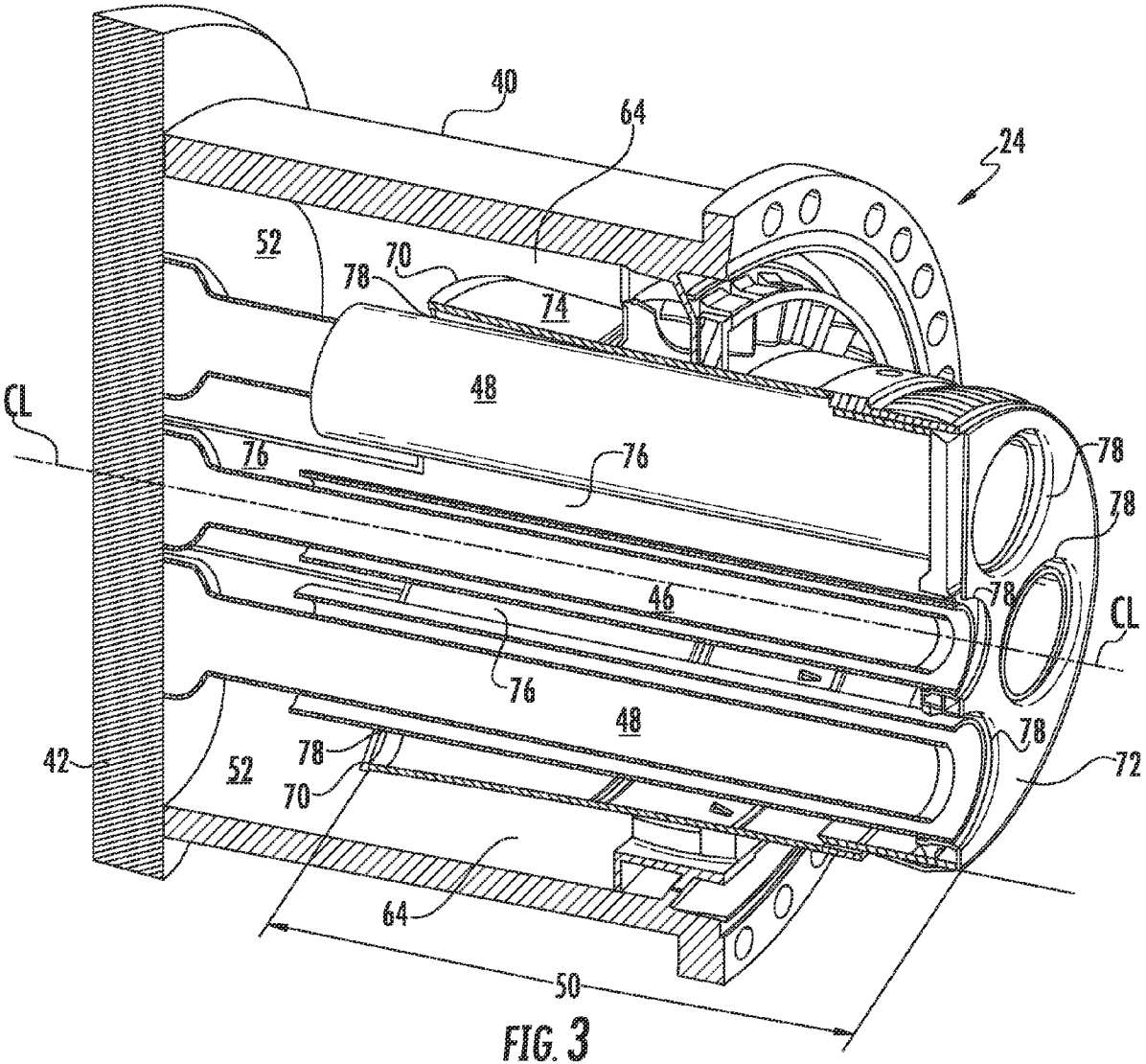
FIG. 3 is a cross-section perspective view of a portion of the combustor as shown in FIG. 2.

FIG. 3 provides a cross-section perspective view of a portion of the combustor 24 as shown in FIG. 2 that incorporates at least one embodiment of the present invention. As shown in FIG. 3, the cap assembly 50 generally includes a base plate 70 that extends radially within the combustor 24 downstream from the end cover 42. A cap plate 72 extends radially within the combustor 24 downstream from the base plate 70. The cap plate 72 is axially separated from the base plate 70 with respect to an axial centerline of the combustor 24. An annular shroud 74 extends at least partially between the base plate 70 and the cap plate 72. The base plate 70 and the shroud 74 and/or the cap plate 72 at least partially define an inner plenum 76 within the cap assembly 50 and/or within the combustor 24. The base plate 70 and the end cover 42 at least partially define the head end plenum 52. The shroud 74 and/or the cap assembly 50 at least partially define the cooling flow passage 64. The base plate 70 at least partially defines at least one fuel nozzle passage 78 that extends through the base plate 70. In particular embodiments, the at least one fuel nozzle passage 78 is further defined by the cap plate 74. In particular embodiments, at least a portion of the primary fuel nozzle 46 extends from the end cover 42, through one of the at least one fuel nozzle passages 78 towards the cap plate 74 and/or at least partially through the cap plate 74. In further embodiments, the at least one secondary fuel nozzle 48 extends from the end cover 42 through one of the at least one fuel nozzle passages 78 towards and/or at least partially through the cap plate 74.

Figure 4:
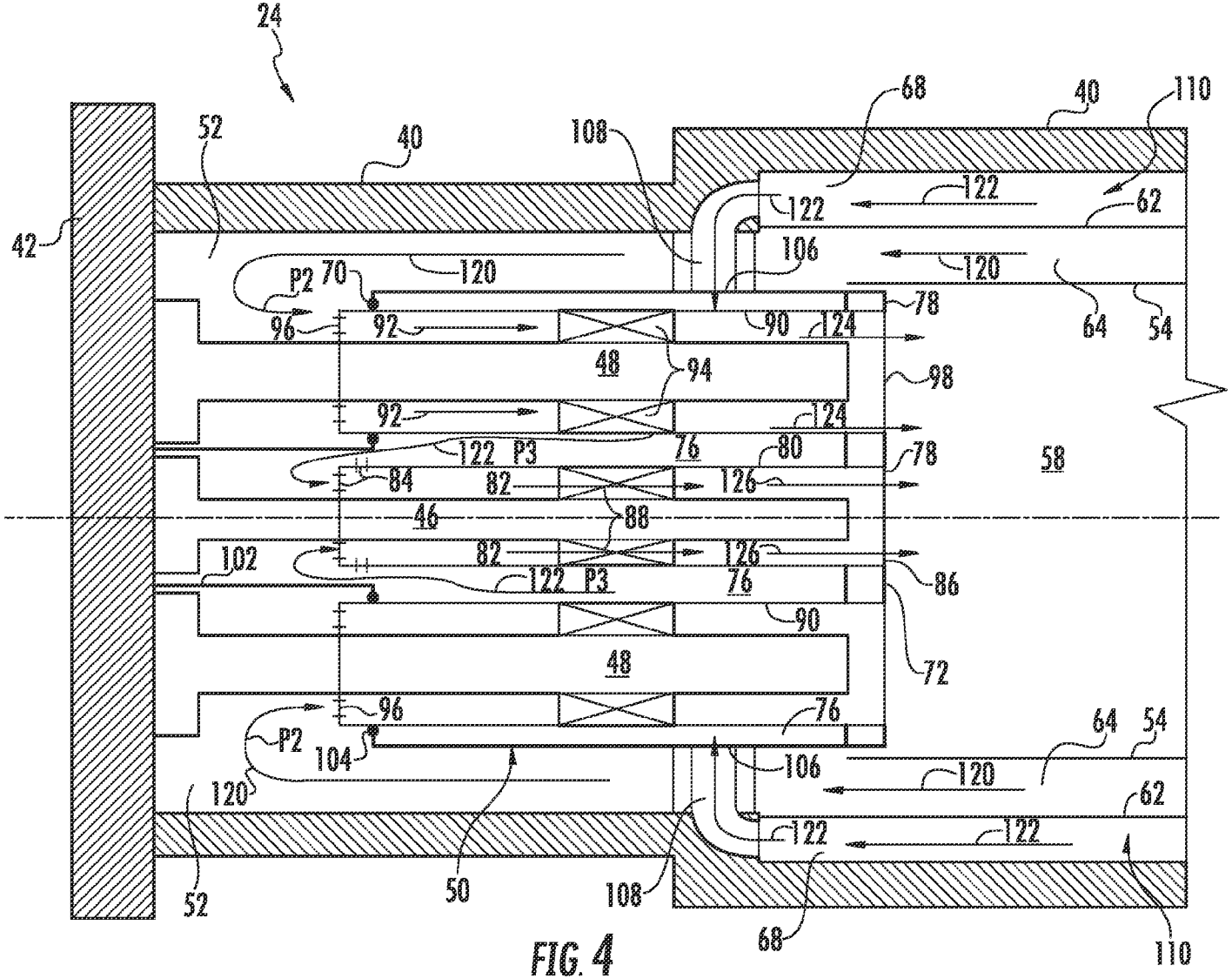
FIG. 4 is an enlarged simplified cross-section side view of the combustor as shown in FIG. 2, according to at least one embodiment.
Figure 5:
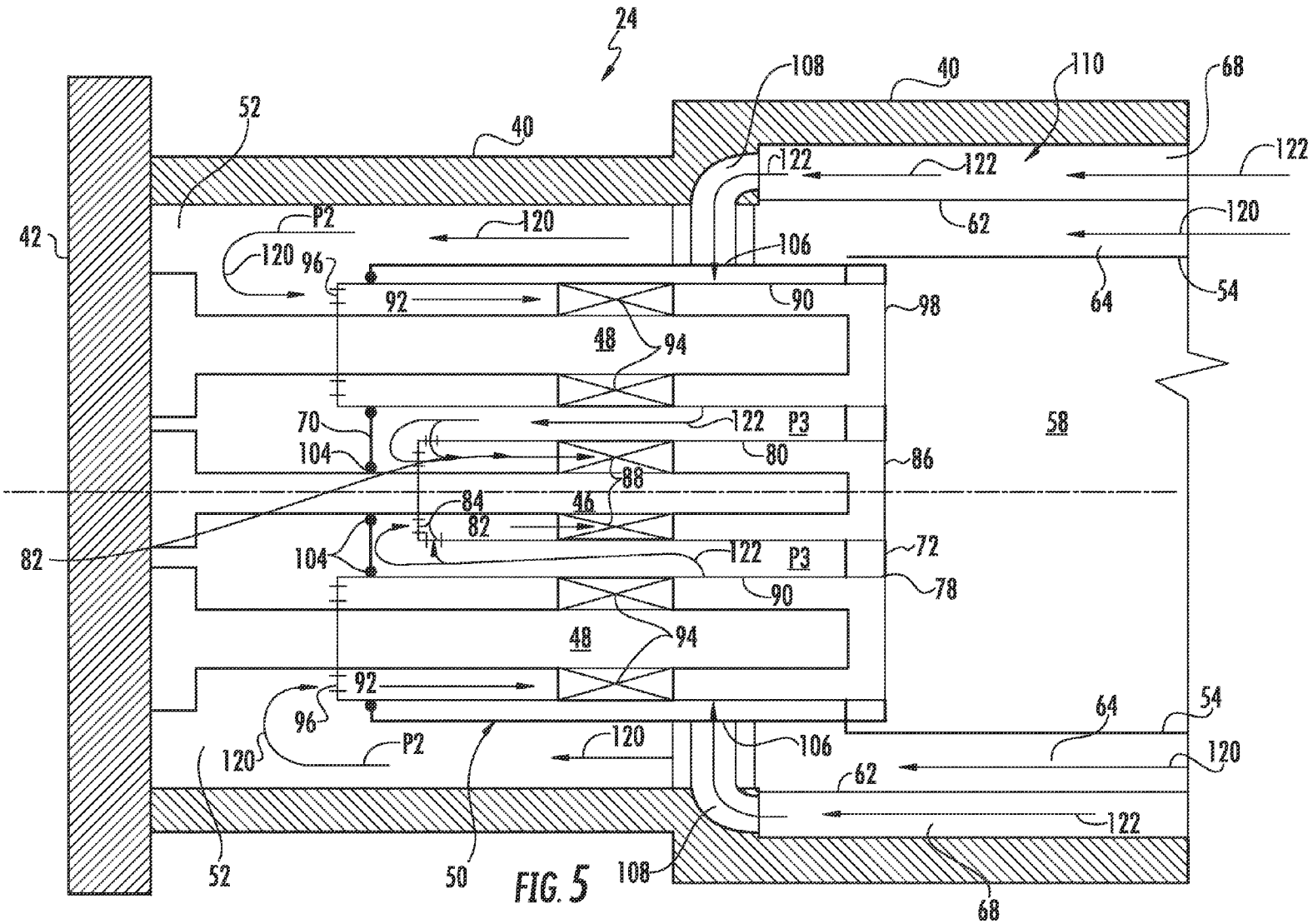
FIG. 5 is an enlarged simplified cross-section side view of the combustor as shown in FIG. 2 according to at least one embodiment.

FIG. 4 provides an enlarged simplified cross-section side view of the combustor 24 as shown in FIGS. 2 and 3, according to at least one embodiment, and FIG. 5 provides an enlarged simplified cross-section side view of the combustor 24 as shown in FIGS. 2 and 3, according to at least one embodiment of the present disclosure. As shown in FIG. 4, an annular burner tube 80 surrounds at least a portion of the primary fuel nozzle 46 to at least partially define a premix flow passage 82 that extends at least partially through the primary fuel nozzle 46, the inner plenum 76 and/or through the cap assembly 50. The burner tube 80 may be connected to the primary fuel nozzle 46 as a singular component or the burner tube 80 may be a separate component. For example, the burner tube 80 may be coupled to the cap plate 72 and/or to the base plate 70 of the cap assembly 50. The burner tube 80 at least partially defines an inlet 84 to the premix flow passage 82 and an outlet 86 from the premix flow passage 82 spaced downstream from the inlet 84 generally adjacent to the cap plate 72. The inlet 84 may be disposed between the primary fuel nozzle 46 and the burner tube 80 and/or may extend through the burner tube 80. In particular embodiments, the inlet 84 is positioned within the inner plenum 76. In various embodiments, a plurality of swirler vanes 88 may be disposed within the premix flow passage 82 between the burner tube 80 and the primary fuel nozzle 46.

In further embodiments, an annular burner tube 90 surrounds at least a portion of the secondary fuel nozzle(s) 48 to at least partially define a premix flow passage 92 through the secondary fuel nozzle(s) 48 and/or through the cap assembly 50. The burner tube 90 may be connected to the secondary fuel nozzle 46 to form a singular component or the burner tube 90 may be a separate component. For example, the burner tube 90 may be coupled to the cap plate 72 and/or to the base plate 70 of the cap assembly 50. In particular embodiments, a plurality of swirler vanes 94 are disposed within the premix flow passage 88 between the secondary fuel nozzle 48 and the burner tube 90. The burner tube 90 at least partially defines an inlet 96 to the premix flow passage 92 and an outlet 98 spaced downstream from the inlet 96 generally adjacent to the cap plate 78. The inlet 96 may be disposed between the secondary fuel nozzle 48 and the burner tube 90 and/or may extend through the burner tube 90. The inlet 96 is in fluid communication with the head end plenum 52.

In particular embodiments, as shown in FIG. 4, an annular baffle or sleeve 102 circumferentially surrounds a portion of the primary fuel nozzle 46. The baffle 102 extends at least partially between the base plate 70 and the end cover 42 to at least partially further define the inner plenum 76 and/or to provide a barrier or seal between the head end plenum 52 and the inner plenum 76. In particular embodiments, the inlet 84 to the premix flow passage 82 of the primary fuel nozzle 46 is disposed at least partially within the baffle 102. In an alternate embodiment, as shown in FIG. 5, the inlet 84 to the premix flow passage 82 of the primary fuel nozzle 46 is disposed within the inner plenum 76 downstream from the base plate 70.

In particular embodiments, as shown in FIGS. 4 and 5, one or more piston seals or annular seals 104 are disposed between the burner tube 90 of the secondary fuel nozzle(s) 48 and a corresponding one of the at least one fuel nozzle passage(s) 78 to seal the inner plenum 76 from the head end plenum 52. As shown in FIG. 5, at least one of the one or more piston seals 104 may be disposed between the primary fuel nozzle 46 and a corresponding one of the at least one fuel nozzle passage(s) 78 to further seal the inner plenum 76 from the head end plenum 52. As shown in FIGS. 4 and 5, an inlet port 106 extends through the shroud 74 of the cap assembly 50 to at least partially define a flow path 108 into the inner plenum 76. The high pressure flow passage 68 at least partially defines a flow path 110 between the high pressure plenum 44 (FIG. 2) and the inlet port 106 and/or the inner plenum 76 of the cap assembly 50.

Figure 6:
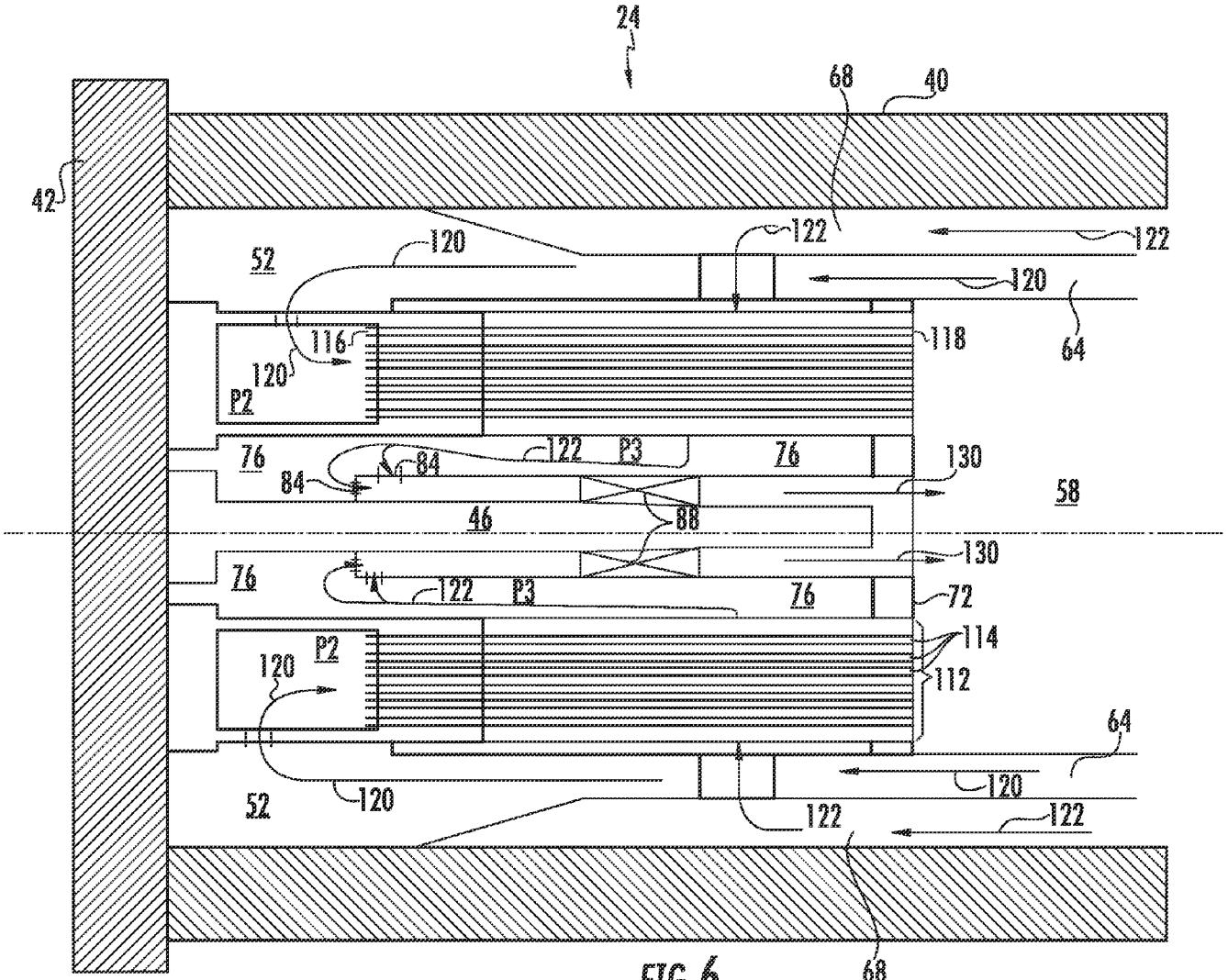
FIG. 6 is an enlarged cross-section side view of the combustor as shown in FIG. 2 according to at least one embodiment.

FIG. 6 is an enlarged cross-section side view of the combustor as shown in FIG. 2, according to at least one embodiment of the present invention. In particular embodiments, as shown in FIG. 6, the primary fuel nozzle 46 is circumferentially surrounded by one or more tube bundle(s) 112. The tube bundle(s) 112 may comprise of a single tube bundle or multiple tube bundles. Each tube bundle 112 generally includes a plurality of tubes 114 that extend through the cap assembly 50 to provide fluid communication through the inner plenum 76. Each tube 114 of the plurality of tubes 114 includes an inlet 116 that is in fluid communication with the head end plenum 52 and an outlet 118 that provides for fluid communication through the cap plate 72 and into the combustion chamber 58.

In operation, as shown in FIG. 2, a first portion 120 of the compressed working fluid 18 flows from the high pressure plenum 44 through the plurality of holes 66 and into the cooling flow passage 64. A second portion 122 of the compressed working fluid 18 flows from the high pressure plenum 44 and into the high pressure flow passage 68. Thermal energy is transferred from the liner 54 to the first portion 120 of the compressed working fluid 18 as it is routed through the cooling flow passage 64 towards the head end plenum 52. Friction with at least one of the flow sleeve 62, the shroud 74 of the cap assembly 50, the liner 54 or the heat transfer features (not shown) of the liner 54 generally results in a significant pressure drop of the first portion 120 of the compressed working fluid 18 as it enters the head end plenum 52 with respect to the first pressure P1 of the compressed working fluid 18 within the high pressure plenum 44. As a result, as shown in FIGS. 4 and 5, the first portion 120 of the compressed working fluid 18 enters the head end plenum 52 at a second pressure P2 which is less than the first pressure P1. At the end cover 42, the first portion 120 of the compressed working fluid 18 reverses direction and flows through the inlet 96 to the premix flow passage 92 of the secondary fuel nozzle(s) 48. Fuel 20 (FIG. 1) from the fuel supply 22 (FIG. 1) may be injected into the premix flow passage 92 and mixed with the first portion 120 of the compressed working fluid 18 to form a combustible mixture 124. The combustible mixture 124 is routed through the premix flow passage 92 into the combustion chamber 58 where the combustible mixture 124 is burned.

As shown in FIGS. 4 and 5, the second portion 122 of the compressed working fluid 18 flows from the high pressure plenum 44 through the high pressure passage 68 and into the inlet 116 to the inner plenum 76 of the cap assembly 50. The high pressure passage 68 is generally shorter than the cooling flow passage 64 and generally free of obstructions as compared to the cooling flow passage 64. As a result, the second portion 122 of the compressed working fluid 18 enters the inner plenum 76 at a third pressure P3 that is greater than the second pressure P2 of the first portion 120 of the compressed working fluid 18 at the head end plenum 52. The second portion 122 of the compressed working fluid 18 flows through the inlet 84 to the premix flow passage 82 of the primary fuel nozzle 46. Fuel 20 (FIG. 1) from the fuel supply 22 (FIG. 1) may be injected into the premix flow passage 82 and mixed with the second portion 122 of the compressed working fluid 18 to form a combustible mixture 126. Due to the higher third pressure P3, the combustible mixture 126 exits the premix flow passage 82 of the primary fuel nozzle 46 at a higher velocity than if the inlet 84 to the primary fuel nozzle were in fluid communication with the head end plenum 52. As a result, the higher velocity of the combustible mixture 126 exiting the premix flow passage 82 of the primary fuel nozzle 46 significantly increases and improves the flame holding capability of the primary fuel nozzle and/or improves the overall performance of the combustor.

In another embodiment, as shown in FIG. 6, the first portion 120 of the compressed working fluid is routed from the high pressure plenum 44 (FIG. 1) at the first pressure P1 through the cooling flow passage 64 and into the head end plenum 52 at the second pressure P2. The first portion 120 of the compressed working fluid 18 flows through the inlet 116 of each of the plurality of tubes 114. Fuel 20 (FIG. 1) from the fuel supply 22 (FIG. 1) may be injected into each tube 114 and mixed with the first portion 120 of the compressed working fluid 18 to form a combustible mixture 128. The combustible mixture 128 is routed through the tubes 114 and flows out of each tube 114 at its corresponding outlet 118 and into the combustion chamber 58 where the combustible mixture 128 is burned.

The second portion 122 of the compressed working fluid 18 flows through the inlet 84 into the premix flow passage 82 of the primary fuel nozzle 46. Fuel 20 (FIG. 1) from the fuel supply 22 (FIG. 1) may be injected into the premix flow passage 82 of the primary fuel nozzle 46 and mixed with the second portion 122 of the compressed working fluid 18 to form a combustible mixture 130. Due to the higher third pressure P3 in the inner plenum 76, the combustible mixture 130 exits the premix flow passage 82 of the primary fuel nozzle 46 at a higher velocity than if the inlet 84 to the premix flow passage 82 primary fuel nozzle 46 were in fluid communication with the head end plenum 52. As a result, the higher velocity of the combustible mixture 130 exiting the premix flow passage 82 of the primary fuel nozzle 46 significantly increases, therefore improving the flame holding capability of the primary fuel nozzle and/or the overall performance of the combustor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed:

1. A combustor for a gas turbine, comprising:

an end cover coupled to a casing, wherein the casing at least partially defines a high pressure plenum, wherein the end cover and the casing form a head end plenum that is in fluid communication with the high pressure plenum;

a cap assembly disposed within the casing, the cap assembly including a base plate axially spaced from the end cover, a cap plate axially spaced from the base plate and a shroud that extends from the base plate to the cap plate, wherein the base plate, the shroud and the cap plate form an inner plenum within the combustor, wherein the inner plenum is fluidly sealed from the head end plenum, and wherein the shroud defines an inlet port that at least partially defines a flow passage from the high pressure plenum into the inner plenum; and a primary fuel nozzle extending from the end cover through the head end plenum, the base plate, the inner plenum and the cap plate, the primary fuel nozzle having a premix flow passage defined between a center body and a burner tube, wherein an inlet to the premix passage is in fluid communication with the inner plenum and is fluidly sealed from the head end plenum.

2. The combustor as in claim 1, wherein an upstream end of the burner tube is disposed within the inner plenum between the base plate and the cap plate.

3. The combustor as in claim 1, further comprising an annular sleeve that extends from the end cover to the base plate, wherein the annular sleeve circumferentially surrounds a portion of the center body of the primary fuel nozzle, and wherein the annular sleeve further defines the inner plenum.

4. The combustor as in claim 1, wherein the head end plenum is in fluid communication with the high pressure plenum via a cooling flow passage defined within the combustor and the inner plenum is in direct fluid communication with the high pressure plenum via a high pressure flow passage defined within the combustor.

5. The combustor as in claim 1, further comprising a plurality of secondary fuel nozzles annularly arranged about the primary fuel nozzle, wherein each respective secondary fuel nozzle comprises a respective tube bundle including a plurality of tubes that extend from the end cover, through the base plate, the inner plenum and the cap plate, each tube of the plurality of tubes for each respective tube bundle having an inlet that is in fluid communication with the head end plenum and an outlet disposed downstream from the cap plate.

6. The combustor as in claim 1, further comprising a plurality of secondary fuel nozzles annularly arranged about the primary fuel nozzle, wherein each secondary fuel nozzle extends from the end cover, through the base plate, the inner plenum and the cap plate, each secondary fuel having a respective premix passage, wherein an inlet to each respective premix passage is in fluid communication with the head end plenum.

7. The combustor as in claim 6, wherein each secondary nozzle includes a respective burner tube that defines the respective premix passage of the respective secondary nozzle, wherein an upstream end portion of each respective burner tube extends within the head end plenum and through the base plate.

8. The combustor as in claim 7, further comprising a plurality of piston seals, wherein each respective piston seal forms a seal between the base plate and a respective burner tube of the respective secondary nozzle.

9. A gas turbine comprising:

a compressor, a combustor downstream from the compressor and a turbine at a downstream end of the gas turbine, wherein the combustor includes an end cover coupled to a casing, the casing being in fluid communication with the compressor and at least partially defining a high pressure plenum that surrounds the combustor, the end cover at least partially defining a head end plenum that is in fluid communication with the high pressure plenum, the combustor further comprising:

a cap assembly disposed within the casing, the cap assembly including a base plate axially spaced from the end cover, a cap plate axially spaced from the base plate and a shroud that extends from the base plate to the cap plate, wherein the base plate, the shroud and the cap plate form an inner plenum within the combustor, wherein the inner plenum is fluidly sealed from the head end plenum, and wherein the shroud defines an inlet port that at least partially defines a flow passage from the high pressure plenum into the inner plenum; and a primary fuel nozzle extending from the end cover through the head end plenum, the base plate, the inner plenum and the cap plate, the primary fuel nozzle having a premix flow passage defined between a center body and a burner tube, wherein an inlet to the premix passage is in fluid communication with the inner plenum and is fluidly sealed from the head end plenum.

10. The gas turbine as in claim 9, wherein an upstream end of the burner tube is disposed within the inner plenum between the base plate and the cap plate.

11. The gas turbine as in claim 9, further comprising an annular sleeve that extends from the end cover to the base plate, wherein the annular sleeve circumferentially surrounds a portion of the center body of the primary fuel nozzle, and wherein the annular sleeve further defines the inner plenum.

12. The gas turbine as in claim 9, wherein the head end plenum is in fluid communication with the high pressure plenum via a cooling flow passage defined within the combustor and the inner plenum is in direct fluid communication with the high pressure plenum via a high pressure flow passage defined within the combustor.

13. The gas turbine as in claim 9, further comprising a plurality of secondary fuel nozzles annularly arranged about the primary fuel nozzle, wherein each respective secondary fuel nozzle comprises a respective tube bundle including a plurality of tubes that extend from the end cover, through the base plate, the inner plenum and the cap plate, each tube of the plurality of tubes for each respective tube bundle having an inlet that is in fluid communication with the head end plenum and an outlet disposed downstream from the cap plate.

14. The gas turbine as in claim 9, further comprising a plurality of secondary fuel nozzles annularly arranged about the primary fuel nozzle, wherein each secondary fuel nozzle extends from the end cover, through the base plate, the inner plenum and the cap plate, each secondary fuel having a respective premix passage, wherein an inlet to each respective premix passage is in fluid communication with the head end plenum.

15. The gas turbine as in claim 14, wherein each secondary nozzle includes a respective burner tube that defines the respective premix passage of the respective secondary nozzle, wherein an upstream end portion of each respective burner tube extends within the head end plenum and through the base plate.

16. The gas turbine as in claim 15, further comprising a plurality of piston seals, wherein each respective piston seal forms a seal between the base plate and a respective burner tube of the respective secondary nozzle.

* * * * *